United States Patent [19]

Warner

[11] 4,287,827

[45] Sep. 8, 1981

[54] COMBINED INKING AND MOISTENING ROLLER

[76] Inventor: Gordon R. Warner, 5624 Stow Canyon Rd., Goleta, Calif. 93017

[21] Appl. No.: 39,785

[22] Filed: May 17, 1979

[51] Int. Cl.[3] ..... B41F 7/36; B41F 31/06

[52] U.S. Cl. ..... 101/141; 101/148; 101/350

[58] Field of Search ..... 101/141, 148, 350

[56] References Cited

U.S. PATENT DOCUMENTS

| | | | |
|---|---|---|---|
| 2,016,085 | 10/1935 | Fawkes | 101/350 |
| 2,090,704 | 8/1937 | Rowell | 101/450.1 |
| 2,406,057 | 8/1946 | Barrett | 101/350 |
| 2,690,119 | 9/1954 | Black | 101/148 |
| 3,213,787 | 10/1965 | Miller | 101/466 |
| 3,285,169 | 11/1966 | Hartwig | 101/350 |
| 3,422,759 | 1/1969 | Brynko | 101/467 |
| 3,645,202 | 2/1972 | Lake | 101/148 |
| 3,902,417 | 9/1975 | Fischer | 101/148 |
| 4,176,605 | 12/1979 | Yoshida | 101/148 |
| 4,211,167 | 7/1980 | Corse | 101/148 |

FOREIGN PATENT DOCUMENTS 903724 8/1962 United Kingdom ..... 101/450.1

OTHER PUBLICATIONS

Deaver; Graphics Arts Monthly; Oct. 1976; pp. 48, 49, 50, 51, 52; Dampening Systems.

Sypula; Xerox Disclosure Journal; vol. 1, No. 8, 8-76; p. 11; Measurement of Fountain Solution.

*Primary Examiner*—Clyde I. Coughenour

*Attorney, Agent, or Firm*—Harry W. Brelsford

[57] ABSTRACT

In a lithographic printing apparatus, the rollers that supply ink and/or water to form rollers have a surface with minutely intermixed hydrophilic and oleophilic areas. The amount of water retained by a roller is dependent upon the total of the hydrophilic areas, and the amount of oil-based ink retained by the roller is dependent upon the total of the oleophilic areas. A preselected ratio of oil to water is obtained by selecting the ratio of hydrophilic areas to oleophilic areas.

5 Claims, 12 Drawing Figures

COMBINED INKING AND MOISTENING ROLLER

DESCRIPTION

This invention relates to the applying of ink and water to lithographic printing plates and printing cylinders, including direct printing plate cylinders and plates and plate cylinders for offset printing. The invention is useful in lithographic and letter press printing.

The inking of lithographic and letter press plates, whether flat or in cylinder form, has always been a difficult problem for high-production printing presses. The image to be printed is defined on the printing surface, usually photographically. To achieve this, photosensitive coatings are disposed on the printing surface, and the photographic exposure produces hydrophilic, or water-loving, areas that absorb water. These areas repel the ink, which is oil-based. The photographic treatment of the surface may also produce oleophilic, or ink-loving, areas that repel water and positively retain the oil-based ink. The subject matter being printed, whether words or pictures, is thus defined by these hydrophilic and oleophilic areas on the plates.

The usual high-production presses use a cluster of rollers to apply water to the plates, and, downstream in printing motion, a second cluster of rollers applies the oil-based ink. In order to obtain a uniform distribution of water and ink, there are conventionally clusters of rollers for water and a separate cluster of inter-engaging rollers for ink. Each cluster may vary from five to sixteen or more in number. In my co-pending U.S. Pat. application, Ser. No. 968,384, filed Dec. 11, 1978, now abandoned, I disclose apparatus for mixing oil and water in a single bath, or fountain, and applying water and oil-based ink simultaneously, thus using only one cluster of rollers (three in number) rather than two large clusters.

The last roller in a cluster, the roller that applies ink or water to a plate cylinder, is generally constructed with a rubber surface and is generally known as a form roller. The form roller contacts the plate cylinder and generally has the same peripheral speed as the plate cylinder. The rollers that apply ink or water to the form roller generally have a metal surface and have a variable speed motor drive so that the peripheral speed may be quite different from the peripheral speed of the form roller in order to spread or thicken the film of oil or water. This relative slippage between these supply rollers and the form roller produces heat, which causes problems.

In addition to the variable of relative peripheral speeds, the pressure between the supply rollers and the form roller is quite critical and varies with the slippage. The adjustment of pressure between these rollers is time-consuming and reduces production time.

I have discovered that an ink fountain roller or a water fountain roller or a combined ink and water fountain roller will function more effectively if its surface is divided into minute areas that are hydrophilic and other minute areas that are oleophilic. I have further discovered that the surface may also contain areas that repel both water and oil by coating with polytetrafluoroethylene, a substance that is sold by one manufacturer under the brand name of "Teflon." This material is generally referred to in the trade as TFE, and sometimes PTFE.

I have used a copper-coated fountain roller that is etched to define water-loving areas and counter-etched to define ink-loving areas. Also, these two areas may be formed on a roller having a chromium surface that is hydrophilic and which has copper areas formed on it to define oleophilic areas. The fountain rollers may be screened to define intagliolike patterns or may contain dots of any desired size as in half-tone printing. These dots may represent the hydrophilic area and the background the oleophilic, or vice versa. In another form, the surface may have minute lines that are preferably parallel of alternating chromium and copper, preferably in a spiral pattern when placed on a cylinder. In still another form a chromium or other hydrophilic surface is constructed to have areas of rubber which is oleophilic.

The pattern need not be uniform. To counteract the usual water deficiency at the ends of the roller, the number of water-loving areas may be increased in proportion to the inkloving areas.

This new type of roller is useful in my combined ink and water fountain, because it automatically picks up the required percentages of water and ink dependent upon the geometry of the hydrophilic and the oleophilic areas. The use of this new roller on the mixed water and ink makes the transfer of water and ink to the form roller independent (within limits) of the intimacy, or minuteness of dispersion of the ink and water mixture.

This automatic control of the correct amount of water and ink is further enhanced by having areas of the roller surface coated with TFE or equivalent materials. This material may be applied by sputtering or similar techniques that result in dispersed lots of TFE. This material repels both water and ink, and, by regulating the area covered with TFE, the amount of water and ink per revolution of the roller is closely controlled.

I have discovered further that my new type of fountain roller makes less critical the pressure of the contact line between fountain rollers, distributing rollers, and form rollers.

Various objects, advantages, and features of the invention will be apparent in the following description and claims, considered together with the drawings forming an integral part of this specification and in which:

FIGS. 9, 10, 11, and 12 are modified forms of roller combinations using the invention.

Figure 1:
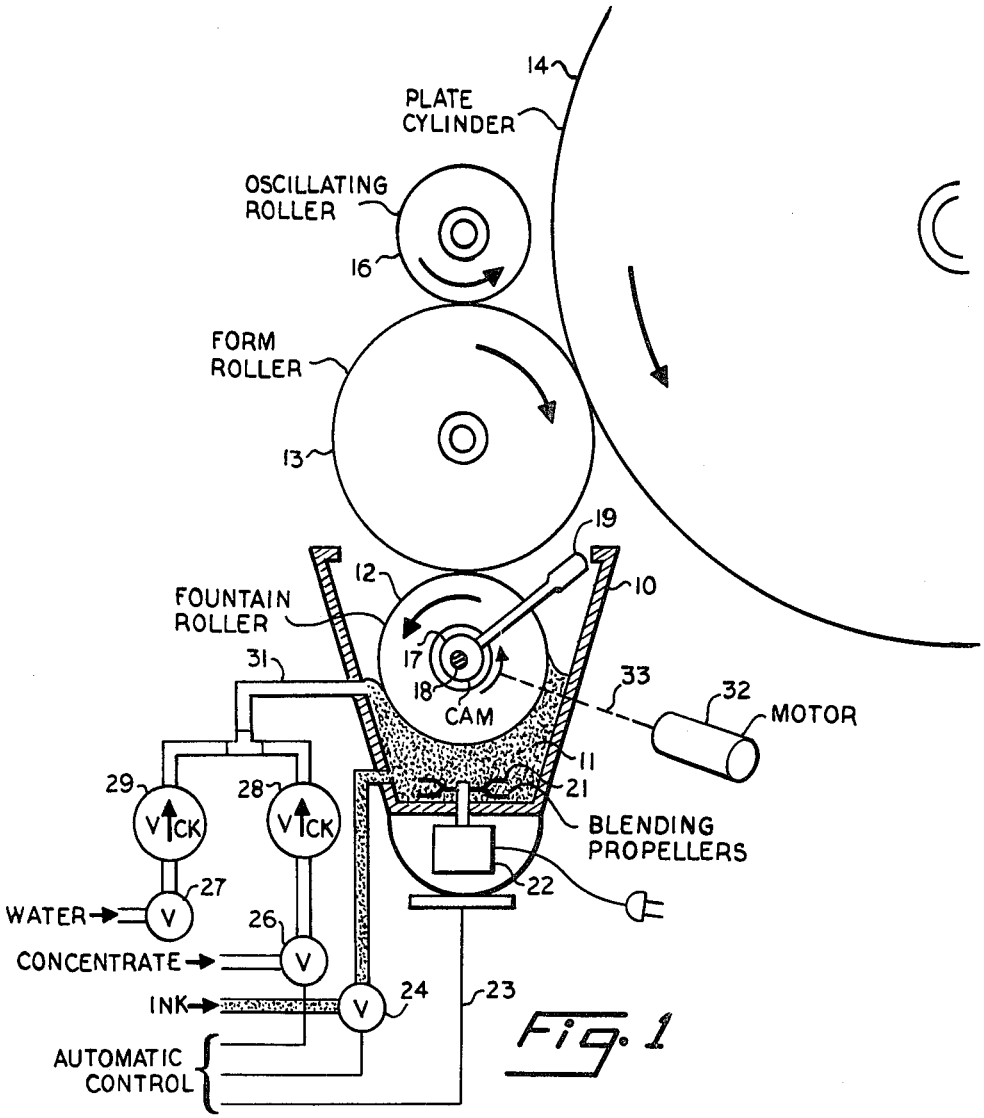
FIG. 1 is a schematic drawing of the apparatus of my prior filed application wherein a mixture of water and ink is applied to a plate cylinder from a single fountain.

Referring to FIG. 1, there is illustrated a fountain or trough 10 containing a mixture of water and ink 11 in which is partially immersed a fountain roller 12, which carries this water and ink mixture to a form roller 13, which in turn is in contact with a plate cylinder 14. As oscillating roller 16 is in contact with the form roller 13, and it oscillates back and forth on its axis of rotation to smooth out any water and ink mixture on the form roller. The pressure of the fountain roller 12 against the form roller 13 is adjusted by virtue of a stationary shaft 17 on which the fountain roller rotates, which is eccentrically mounted about a center 18 so that the shaft acts as a cam and may be manually rotated by means of a handle 19.

The mixture of ink and water is blended by blending propellers 21 driven by a motor 22 actuated by a control wire 23. Ink from a supply source is controlled by a valve 24, fountain concentrate is controlled by a valve 26, and a supply of water is controlled by a valve 27. Check valves 28 and 29 isolate the water from the fountain concentrate, and the mixture of the two is delivered by a pipe 31 to the trough, or fountain, 10. The fountain roller 12 is rotated at a variable speed by a motor 32 acting through a drive shaft 33 as shown schematically.

The operation of the apparatus of FIG. 1 is as follows. Ink is supplied by opening the solenoid valve 24 by a suitable automatic control (not shown), and concentrate and water are added to the trough, or fountain, 10 by a suitable operation of the solenoid valves 26 and 27, preferably also by automatic control (not shown). The mixture 11 of water and oil is blended intimately by propellers 21 driven by the motor 22 under the control of automatic apparatus (not shown) to which the wire 23 connects the motor. The mixture of water and oil is not homogenized, but instead is merely intimately mixed so that there are discrete particles of water and oil present.

The fountain roller 12 is partially immersed in this mixture of water and ink, which collects on the surface by virture of the oleophilic areas and the hydrophilic areas shown in more detail in FIGS. 3 through 8. This water and ink mixture is carried to the form roller 13 by virtue of the contact between the two rollers. The amount of pressure beween the two rollers is manually adjusted by rotating the lever 19 about the eccentric axis 18. The form roller 13 deposits the water and ink mixture on the plate cylinder 14 by virtue of its contact with that cylinder. This mixture will also be in the form of discrete particles of water and ink. If there is any lack of uniformity of dispersion of water and ink particles over the surface of form roller 13, this lack of uniformity is corrected by the oscillating roller 16 which oscillates back and forth on its axis of rotation as it rotates.

Figure 2:
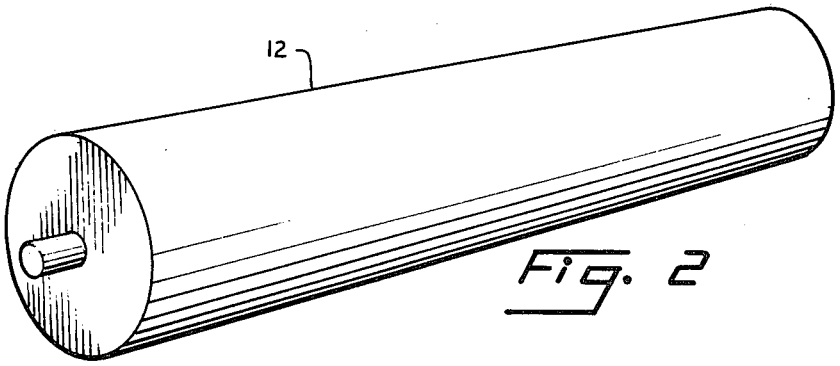
FIG. 2 is a three-dimensional illustration of either the fountain roller of FIG. 1 or the form roller of FIG. 1 having a surface formed in accordance with the invention.
Figure 12:
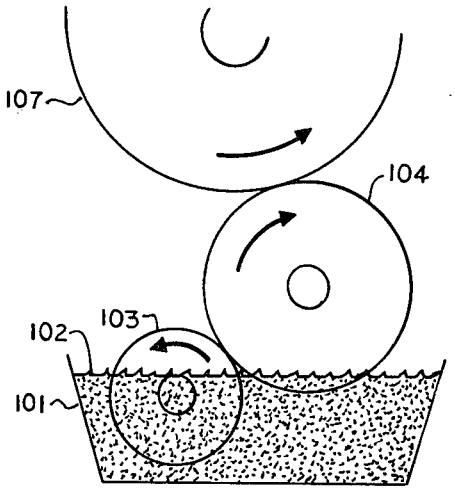

Referring to FIG. 2, there is illustrated one of the rollers in the train of rollers from the fountain 10 to the plate cylinder 14. At present, I prefer to have the fountain roller 12 formed in accordance with my invention, but the invention is applicable also to the form roller 13. Accordingly, FIG. 12 illustrates not only the fountain roller 12, or equivalent, but the form roller 13.

Figure 3:
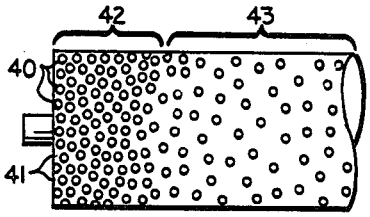
FIG. 3 is a schematic diagram of one form of surface for the roller of FIG. 2 wherein one of the areas is in the form of dots and the other is the background.

Illustrated in FIG. 3 is a schematic diagram of one type of surface on the roller of FIG. 2. This may consist of hydrophilic areas 40 on the surface of the roller, and the background may consist of oleophilic areas. It will be noted that the hydrophilic areas 40 are denser and use up a greater portion of the area toward the end of the cylinder of FIG. 3 as shown by the bracket 42 compared to the area designated by the bracket 43 where there is much less hydrophilic area as compared to the oleophilic background 41. This concentration of hydrophilic areas at the end of the roller corrects the usual condition found in fountain rollers and from rollers or other rollers in a cluster for applying ink or water or a mixture of both wherein conventionally there is insufficient amount of water at the ends of the rollers.

Figure 4:
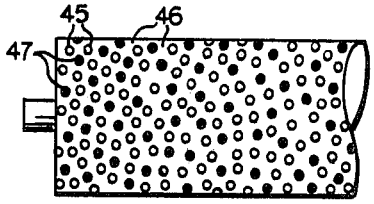
FIG. 4 is a schematic diagram of the surface of the rollers of FIG. 2 wherein one of the hydrophilic or oleophilic areas is represented by open circles and the other is the background, but wherein there are also areas of water-repellant and oil-repellant material represented by black circles.

Illustrated in FIG. 4 is a roller having areas 45 which may be hydrophilic or oleophilic. If hydrophilic, then the background 46 is oleophilic, or vice versa. Interspersed among these areas 45 are areas 47 that repel both the water and oil. Accordingly, these areas limit the total amount of water and oil that can by picked up by a cylinder. At present, I prefer to use polytetrafluoroethylene, commonly referred to in the chemical trade as PTFE and sometimes TFE. The brand presently sold under the name of "Teflon" is preferred.

Figure 5:
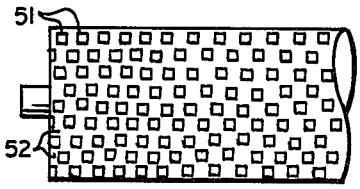
FIG. 5 is a schematic illustration on an enlarged scale of the use of rectangular areas of either hydrophilic or oleophilic material on the surface of the roller of FIG. 2.

Illustrated in FIG. 5 is still another surface for the roller of FIG. 2 wherein the areas are rectangular in shape. Thus, squares or rectangles 51 may be formed on a background 52 to define hydrophilic or oleophilic areas. If the areas 51 are hydrophilic, the background 52 is oleophilic, or vice versa.

Figure 6:
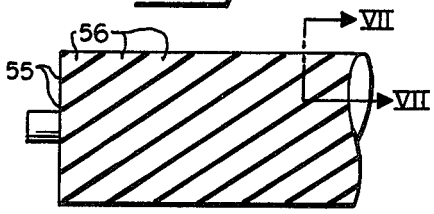
FIG. 6 is a schematic diagram of still a different surface for the roller of FIG. 2 wherein there are lines of either oleophilic or hydrophilic area, and the background is composed of the other of these two areas.
Figure 7:
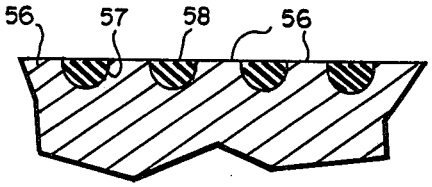
FIG. 7 is a diagram on a greatly enlarged scale of the cross section along the line VII—VII showing a scoring of the surface of the roller of FIG. 6 and wherein a rubber-like material has been disposed in the score marks to form the oleophilic areas.

Illustrated in FIGS. 6 and 7 is still another type of surface for the roller or rollers of FIG. 2 wherein material is deposited in very fine score marks made on the surface of the roller. Thus, generally parallel lines 55 may be formed of oleophilic material, and the spaces 56 between the lines may be hydrophilic. For example, this may be a chromium surface in which the lines are scored in a very fine pattern, and the score marks are then filled with a rubber-like material, which is then caused to adhere to the surface. This construction is illustrated in FIG. 7 wherein a plurality of score marks or grooves 57 are formed in the surface 56. The grooves 57 are filled with a rubber-like material 58. Rubber is normally oleophilic, and chromium hydrophilic. Thus, the areas 58 and 56 will define oleophilic and hydrophilic areas, respectively. The spacing and width of the score marks, or grooves, 57 with respect to the spaces 56 between them determine the relative amount of water and ink that is picked up or retained on the surface of the roller.

Figure 8:
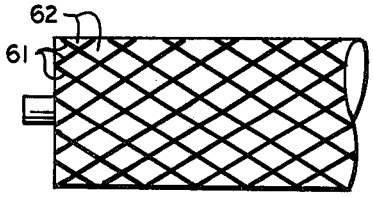
FIG. 8 is a schematic diagram of the surface for the roller of FIG. 2 wherein the lines on the surface are cross-hatched for greater density of either the oleophilic or hydrophilic material.

Illustrated in FIG. 8 is another modification similar to that of FIG. 6, but wherein there is a cross hatch of grooves that hold rubber-like material 61 and the areas 62 between the grooves or lines 61 define the hydrophilic areas.

An alternative construction for FIGS. 6 and 8 is to have the lines 55 of FIG. 6 and the lines 61 of FIG. 8. formed of an oleophilic metal such as copper.

Figure 9:
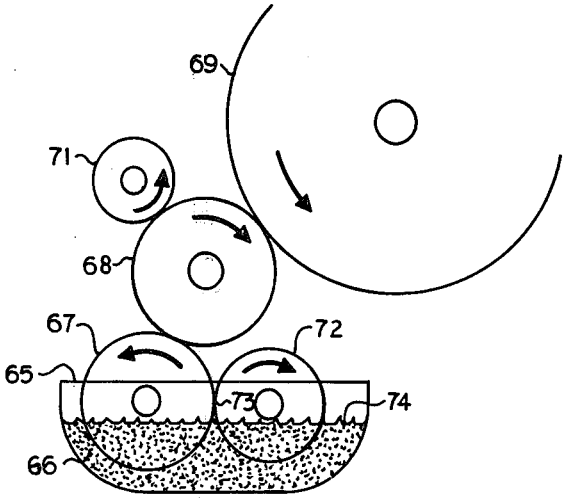

Referring to FIG. 9, there is illustrated apparatus similar to that of FIG. 1, but wherein there is added a squeegee roller to reduce or eliminate the buildup of water-ink mixture at the contact line or nip of the fountain roller and the form roller. In FIG. 9, a fountain trough 65 contains a blended mixture of water and oil-based ink 66 in which is partially immersed a fountain roller 67 having a rolling engagement with a form roller 68, which in turn has a rolling engagement with a plate cylinder 69. If desired, an oscillating roller 71 may engage the form roller 68 to evenly distribute the water and ink mixture over the surface of the form roller.

Provided at the fountain is a squeegee roller 72, which has a line of contact or nip 73 with the fountain roller 67, and this line or nip 73 is just above the normal level 74 of the water-ink mixture. The squeegee roller 72 preferably has a surface of rubber-like material, and by adjusting the pressure between rollers 72 and 67 the precise thickness of film of water and ink is achieved. I have found that the greater the pressure the greater is the proportion of ink to water, although the total of both is reduced by greater pressure. This pressure relationship, therefore, constitutes another proportion control between ink and water. This relationship applies whether the fountain roller 67 is a uniform surface roller or a surface having intermixed hydrophilic or oleophilic areas. I presently prefer to have the surface of squeegee roller 72 uniform as to attraction for water or ink, and I presently do not make this surface with intermixed hydrophilic and oleophilic areas. The surface of squeegee roller 72, however, could be composed of mixed hydrophilic and oleophilic area. I presently prefer to have the nip line 73 right at the level of the liquid 74 in order to bathe the nip in the mixture to maintain a full volume of mixture against the rollers.

Referring still to FIG. 9, the fountain roller 67 preferably has intermixed hydrophilic and oleophilic areas, the form roller 68 may have the standard rubber-like surface of conventional form rollers, the oscillating roller 71 may have a copper or nylon surface, and the plate cylinder may have a standard lithographic surface. Letterpress or flexograph plates may also be used.

Referring now to FIGS. 3 through 8, there are various methods of construction of the surfaces of the rollers; therefore, only the presently preferred methods are described. The hydrophilic areas 40 on the surface of the roller of FIG. 3 are chromium, and the oleophilic background 41 is copper. This is preferably constructed by copper-plating a steel cylindr, polishing it, and then coating with a photo-resist. A photographic negative is then wrapped around the cylinder, and the cylinder is rotated to expose the resist to a strong light. The unexposed areas (areas 41) are then washed off, the remaining resist is hardened, and the cylinder is chromium-plated. The chromium is deposited only on the bare copper and not on the resist. The resists is then removed, leaving a pattern of chromium 40 (hydrophilic) and the background 41 of copper (oleophilic). The thickness of the chromium is so small, on the order of one thousandth of an inch or less, that the resultant roller is smooth for distribution purposes.

The application of PTFE to the roller of FIG. 4 may be accomplished by silk-screenning liquid PTFE, or by flame spraying fine particles to spatter small particles on the surface, either directly or through a mask. Also, vacuum deposition may be employed wherein a static charge is placed on the roller, a mask is placed over the roller having holes where the PTFE is desired, and a pot of PTFE is heated to boiling or vaporizing temperature in the vacuum chamber.

The rectangular areas 51 of FIG. 5 may be formed similarly to areas 40 of FIG. 3.

The roller of FIGS. 6, 7, and 8 may be formed in several ways. The grooves 57 may be etched by standard etching procedures such as the one described for FIG. 3. A steel roller is copper-plated, polished, and then chrome-plated. The chrome is then etched as shown in FIG. 7. The roller is next covered with unvulcanized rubber, vulcanized under pressure, and then the roller is ground to remove the excess rubber so that the remaining rubber 58 is flush with the surface of the chrome 56 as shown in FIG. 7.

I have also successfully used minute grinders to grind the grooves 57 and presently prefer to copper-plate and then chrome-plate a roller. The roller is mounted in a lathe for slow rotation while a battery of grinding wheels moves lengthwise on the carriage. The number of grooves per inch, measured transversely to the grooves, should be ten or more per inch. I presently prefer to form the grooves 57 in a spiral pattern at an angle of approximately fifteen degrees to the roller axis, although grooves parallel to the axis or at different angles to the axis will work. The grooves ground in the surface may be filled with a rubber-like material as previously described, or where the chrome plate is thin, they merely cut through the chromium to expose the copper, which is oleophilic.

Another method of making a chrome and copper surface similar to FIGS. 6 and 8 is to coat a resist on a copper-coated roller, wrap a negative with spiral lines, expose to light, and wash off the exposed resist. Chromium may then be placed on the bare copper in a spiral pattern or any other pattern, depending upon the negative.

The surface of the roller of FIG. 8 may be formed by knurling a chromium or other hydrophilic surface. If this causes raised edges along each groove, the roller may be ground to remove any projections, and the grooves are then filled with rubber as described previously and the execess rubber ground off.

Another method of forming oleophilic areas is to prick the surface with multiple needle-like tools. The resultant crater edges are then ground off, and the holes in the surface filled with a rubber-like material as described previously.

Various other techniques of manufacture are available, especially those known in the engaving and photo-engraving industries and the mechanical or machine shop industry.

In this description I have referred to various rollers and cylinders being in contact with each other. Close inspection shows, however, that they seldom touch each other as they are always separateed by a film of ink, water, or ink and water mixtures. The term "contact" is, therefore, used with this fact in mind to indicate that a roller bears against another roller or cylinder.

Figure 10:
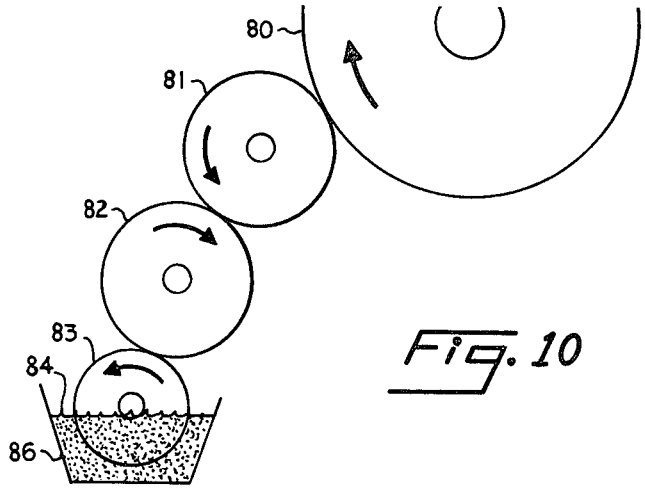

FIG. 10 is a schematic drawing of another modification which I have used to convert an existing press to my water and ink mixture. A conventional lithographic plate cylinder 80 is contacted or engaged by a conventional form roller 81, which is turn is engaged by a fountain roller 83, which is partially immersed in a water and ink mixture 84 held in a trough or fountain 86. In this series of three application rollers, the middle or intermediate roller is provided with a surface having intermixed hydrophilic and oleophilic areas. This intermediate roller substitution of my new roller in one type of conventional press results in minimum cost in converting an existing press. Here again, all three rollers 81, 82, and 83 could have the surfaces of intermixed hydrophilic and oleophilic areas.

It will be appreciated that my fountain rollers having intermixed hydrophilic and oleophilic surfaces (with or without PTFE areas) have great utility in applying my mixture of ink and water, but such a roller may also be advantageously used in conventional lithographic presses with separate ink and water-applying systems. The intermixed areas provide a means and method of regulating the amount of liquid picked up by a fountain roller and help to maintain the uniformity of film as well as correct water deficiency at the ends of the roller.

The cluster of rollers is often referred to in the industry as "distribution" rollers, whether for water or ink.

In letterpress, flexograph, or other nonlithographic printing system, the principles of my idea of using different surfaces on a single roller (such as steel and TFE) could be used in placed of the usual Anilox roller, which uses mechanical means to reduce the amount of ink to be transferred.

Figure 11:
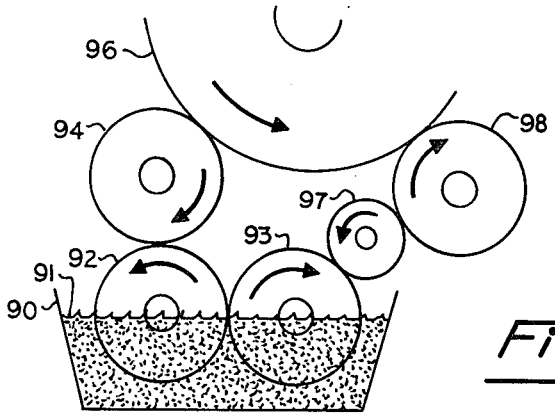

FIG. 11 is a diagram of a modified form of the invention employing two form rollers, the upstream form roller applying more water than ink and the downstream form roller applying more ink than water. Such a sequence may give higher quality results. A trough or fountain 90 contains a blended mixture 91 of water and oil-based ink, and partially immersed in the mixture are form rollers 92 and 93 in rolling engagement so that they squeegee each other. However, the surfaces of these two fountain rollers 92 and 93 are quite different, roller 92 having a surface with a predominance of hydrophilic areas and roller 93 having a predominance of oleophilic areas. I presently prefer to have roller 92 pick up about eighty per cent water and twenty percent ink and transport this to a form roller 94, which in turn is in engagement with a lithographic plate cylinder 96. The percentages are illustrative only as this percentage will vary with many factors, including paper finish, ink composition, paper humidity, pressure of the rollers and cylinder, etc.

I presently prefer to have on the surface of the fountain roller 93 intermixed hydrophilic and oleophilic areas, so that it picks up about twenty percent water and eighty percent ink, although, again, these percentages are illustrative and will vary according to many factors, including the percentages transported by the fountain roller 92. The water and ink are transported to an intermediate idler roller 97, which in turn transfers water and ink to a form roller 98, which then transfers water and the ink to the plate cylinder 96. The prior or upstream moistening of the plate cylinder gives more accurate water retention on the hydrophilic non-forming areas formed on the plate cylinder. The downstream roller gives more accurate ink retention on the oleophilic image areas, because the moistened areas will more accurately repel ink.

Both form rollers 94 and 98 may have oscillating rollers (not shown) to even the water and ink distribution. The fountain rollers 92 and 93 may have a greater concentration of hydrophilic areas at the ends, and, if desired, the form rollers 94 and 98 may have treated surfaces with end concentrations of hydrophilic areas.

FIG. 12 is a diagram for supplying ink only to a letterpress plate cylinder wherein the image to be printed is in relief. A fountain trough contains ink 102, but no water. Partially immersed in this ink is a form roller 104, which is sequeegeed by a squeegee roller 103. The ink is transferred to a relief letterpress cylinder 107.

The amount of ink picked up is regulated by forming the surfaces of the squeegee roller 103 and form roller 104 to provide only a certain percentage of ink-carrying capacity. Intermixed areas of rubber and PTFE or copper and PTFE will regulate the amount of pickup. I presently prefer to make the surface of roller 104 of rubber having PTFE spots. These non-oleophilic surfaces, therefore, regulate the amount of ink transported to the letterpress plate cylinder 107. The liquid in fountain 101 could also be a mixture of water and oil-based ink for use on a lithographic plate cylinder.

Referring to FIGS. 9, 11, and 12, the rotating action of rollers partially immersed in the water and ink mixture, or inbalance, causes the liquid to rise at the region of the nip because of adherence to the surface of such rollers. The nip should be close to the static level of the liquid in the fountain so that the dynamic action of the rollers will fill the space between the static level of the liquid surface and the nip. The nip may be below the surface of the liquid. If the nip is too far above the static liquid surface, then a squeezed-out bead will be formed along the lower edge of the nip. This bead is frequently uneven, which causes uneven amounts of liquid along the nip line, giving uneven delivery of liquid.

The volume of liquid mixture transported by the rollers may be regulated by varying the static level of the liquid with respect to the nip line, because there is less adherence for a roller that only slightly dips into the liquid.

I claim:

1. In a lithographic printing press, the combination of:
(a) a printing press fountain having a blended mixture of water and oil-based ink;
(b) a fountain roller contacting the water and ink mixture;
(c) and a squeegee roller contacting the fountain roller to limit the amount of water and ink mixture carried by the fountain roller;
(d) a lithographic printing plate separate from the fountain roller;
(e) and means to transport the particles of water and ink from the fountain roller to the lithographic printing plate, characterized by said fountain roller having a lithographic surface of intermixed hydrophilic and oleophilic areas, whereby the fine particles of ink and water are selectively taken from the fountain and transported in measured proportions to properly ink and dampen the plate cylinder.

2. The combination of claim 1 wherein the fountain roller hydrophilic areas and oleophilic areas are formed in generally parallel lines.

3. The combination of claim 1 wherein means are provided for adjusting the pressure between the squeegee roller and the fountain roller.

4. The combination of claim 1 wherein part of the squeegee roller is immersed in the blended fountain mixture of water and ink.

5. The combination of claim 1 wherein the fountain mixture of water amd oil-based ink has a surface, part of the squeegee roller is immersed in the fountain mixture, and the nip between the fountain roller and the squeegee roller is substantially at said surface of the fountain mixture.

* * * * *